US008800451B2

(12) United States Patent
Sawada et al.

(10) Patent No.: US 8,800,451 B2
(45) Date of Patent: Aug. 12, 2014

(54) GAS GENERATOR

(75) Inventors: Tetsuya Sawada, Iwamizawa (JP); Toshihiko Tamura, Sakuragawa (JP); Masayuki Shiraishi, Sakuragawa (JP)

(73) Assignee: Showa Kinzoku Kogyo Co., Ltd., Ibaraki-ken (JP)

( * ) Notice: Subject to any disclaimer, the term of this patent is extended or adjusted under 35 U.S.C. 154(b) by 0 days.

(21) Appl. No.: 13/387,591

(22) PCT Filed: Mar. 5, 2010

(86) PCT No.: PCT/JP2010/054158

§ 371 (c)(1),
(2), (4) Date: Jan. 27, 2012

(87) PCT Pub. No.: WO2011/013397

PCT Pub. Date: Feb. 3, 2011

(65) Prior Publication Data

US 2012/0118193 A1 May 17, 2012

(30) Foreign Application Priority Data

Jul. 29, 2009 (JP) ..... 2009-176244

(51) Int. Cl.
*B60R 22/26* (2006.01)
*C06D 5/00* (2006.01)

(52) U.S. Cl.
USPC ..... 102/530; 102/202.9; 280/741

(58) Field of Classification Search
USPC ..... 102/530, 531, 202.9, 202.7, 202.8, 102/202.14; 280/741
See application file for complete search history.

(56) References Cited

U.S. PATENT DOCUMENTS 2,515,780 A * 7/1950 Lefren ..... 86/1.1
2,981,186 A * 4/1961 Stresau ..... 102/202.9
3,002,458 A * 10/1961 Haas ..... 102/202.1
3,249,047 A * 5/1966 Gill et al. ..... 102/202.14

(Continued)

FOREIGN PATENT DOCUMENTS

EP 1990088 A1 * 11/2008 ..... B60R 21/264
JP 2001-021293 A 1/2001

(Continued)

OTHER PUBLICATIONS

Written Opinion of the International Searching Authority for PCT/JP2010/054158; Jul. 2012.*

*Primary Examiner* — James Bergin
(74) *Attorney, Agent, or Firm* — Sughrue Mion, PLLC

(57) ABSTRACT

The present invention configures a gas generator (A) wherein, with regard to a plug assembly (2), a ring (22) is formed of insulative resin, electrode pins (21) are equipped midway with flange portions (21*a*), and these flange portions (21*a*) are integrally formed in a state embedded inside the ring (22), and, in addition, the diameter of the flange portions (21*a*) is made a larger diameter than the short sides of this opening portion (1*a*) of the holder (1), the sum of the sector angles (R) formed by the outer peripheral portions (21*r*) of the flange portions (21*a*) of the electrode pins (21) located outside the opening portion of the holder (1) and the electrode pins (21) is configured to be 180 degrees or greater, the flange portions (21*a*) of the electrode pins (21) are further made mutually non-contacting, and the minimum distance (D) between the electrode pins (21) and the periphery of the opening portion (1*a*) of the holder (1) through which these electrode pins (21) are inserted is made 0.5 mm.

8 Claims, 3 Drawing Sheets

(56) References Cited

U.S. PATENT DOCUMENTS

| | | | | |
|---|---|---|---|---|
| 5,648,634 | A * | 7/1997 | Avory et al. | 102/202.1 |
| 5,728,964 | A * | 3/1998 | Avory et al. | 86/1.1 |
| 5,763,814 | A * | 6/1998 | Avory et al. | 102/202.7 |
| 5,932,832 | A * | 8/1999 | Hansen et al. | 102/202.4 |
| 6,164,208 | A * | 12/2000 | Hsu et al. | 102/202.5 |
| 7,530,310 | B2 * | 5/2009 | Hironaka et al. | 102/202.7 |
| 8,069,789 | B2 * | 12/2011 | Hummel et al. | 102/202.12 |
| 8,176,851 | B2 * | 5/2012 | Kodama et al. | 102/530 |
| 8,205,554 | B2 * | 6/2012 | Fink | 102/202.14 |
| 2002/0162476 | A1 * | 11/2002 | Parker et al. | 102/530 |
| 2007/0193464 | A1 * | 8/2007 | Hironaka et al. | 102/200 |
| 2010/0186615 | A1 | 7/2010 | Kodama et al. | |

FOREIGN PATENT DOCUMENTS

| | | | |
|---|---|---|---|
| JP | 2003-205823 | A | 7/2003 |
| JP | 2004-114826 | A | 4/2004 |
| JP | 2005-280585 | A | 10/2005 |
| WO | WO 2007/083663 | A1 | 7/2007 |

* cited by examiner (PRIOR ART)

GAS GENERATOR

CROSS REFERENCE TO RELATED APPLICATIONS

This application is a National Stage of International Application No. PCT/JP2010/054158 filed Mar. 5, 2010, the contents of which are incorporated herein by reference in their entirety.

TECHNICAL FIELD

The present invention relates to a gas generator, particularly to an improvement of an electric-ignition-type gas generator suitable for actuating a seatbelt pretensioner.

BACKGROUND ART

Cars and other vehicles are usually equipped with seatbelts, airbags and other safety devices for protecting the driver and passengers from the impact at the time of a crash. In the case of a seatbelt safety device, for example, the seatbelt winding-retraction device is additionally provided with a rapid winding-retraction means, and the driver and passengers are reliably protected from the impact at the time of a crash by activating this rapid winding-retraction means at the time of an accident or other emergency so as to instantaneously retract the seatbelts. As the aforesaid rapid winding-retraction means ones have recently been widely adopted that are equipped with a mechanism for rapidly retracting the seatbelt by using an electric ignitor that is activated by the impact at the time of a crash to instantaneously drive a cylinder piston or a rotor by utilizing the pressure of combustion gas when gunpowder or the like is made to burn instantly. The wide adoption of rapid winding-retraction means equipped with such mechanisms has been accompanied by the development of many gas generators for use therein.

[Patent Document 1]

FIG. 5 is a schematic longitudinal section for explaining one conventional example of a gas generator applied to a seatbelt or other vehicle safety device, which is disclosed in Japanese Unexamined Patent Publication No. 2003-205823 (Patent Document 1).

A gas generator B is first provided with a holder 1A constituting a base. The holder 1A is formed of aluminum, and a connector insertion hole 11 is formed on the side attached to the vehicle body while a pedestal 12 for forming an ignitor unit is formed on the reverse side of the place where the connector insertion hole 11 is formed. The pedestal 12 comprises an outer peripheral portion having a flat boundary surface and a spacer insertion hole of circularly indented shape, and the center region of the spacer insertion hole is formed with a rectangular through-hole communicating with the connector insertion hole 11. Further, a resin spacer 13 provided with a pair of pin insertion holes 131 opening toward the connector insertion hole 11 is inserted into the spacer insertion hole and the rectangular through-hole of the pedestal 12. A plug assembly 2A equipped with a pair of electrode pins 21A serving as an electric signal input section is mounted on top of this spacer 13 and the outer peripheral portion of the pedestal 12 so as to sandwich a gasket 14 serving as a sealing material. Moreover, a peripheral wall 121 for ignitor unit attachment that is used to fix the ignitor unit is provided along the outer edge of the pedestal 12, and a peripheral wall 122 for case attachment that is used to fix a case charged internally with ignitor composition, gas generating agent and the like is further provided along the outer periphery of the peripheral wall for ignitor unit attachment.

The plug assembly 2A is equipped with a plug comprising a ring 22A made of metal and having a cylindrical side surface, the pair of electrode pins 21A that pass through this ring 22A, and an insulator 23 for fixing the pair of electrode pins 21A to the ring 22A. Note that the insulator 23 is constituted of glass, ceramic or other such insulator.

The ring 22A has a crimp margin at the portion mounted on the flat border surface of the pedestal 12 so that it is fixed by swaging the peripheral wall 121 for ignitor unit attachment of the holder 1A. The electrode pins 21A are electrically conductive members manifesting a cylindrical shape of finer diameter than the pin insertion holes 131 and extend in parallel with each other. On the side of insertion into the pin insertion holes 131, the electrode pins 21A pass through the insulator 23 and project a long distance, and project only slightly on the opposite side. And a resin sleeve 24 and a disk-shaped board 25 made of composite plastic are disposed on the ring 22A on this side where the electrode pins 21A project slightly. A resistor 26 composed of a thin film of nichrome alloy is provided on at least one side of the board 25 as a heating element. A primary charge 27 is placed on this resistor 26 and a coating 27*a* is additionally placed thereover.

Further, a hollow circular cylinder-shaped cylindrical body 28 is provided on the plug assembly 2A to cover the outer surfaces of the ring 22A and sleeve 24. Since the cylindrical body 28 is fixed by swaging the peripheral wall 121 of the holder 1A in the state fitted over the ring 22A, it is, like the ring 22A, formed along the lower edge with a crimp margin.

And the plug assembly 2A is fixed to the holder 1A by bending and crimping the upper edge portion of the peripheral wall 121 for ignitor unit attachments. Since the gasket 14 is press-fitted between the outer peripheral portion of the pedestal 12 and the lower edge of the ring 22A during this crimping, air-tightness is established between the holder 1A and the plug assembly 2A.

Further, the gas generator B is provided with a case 3A surrounding the ignitor unit comprising the holder 1A and the plug assembly 2A. The case 3A is an aluminum shaped part configured as a cylinder having a bottom that comprises an open portion having a thickness and inside diameter of a scale that can be fitted into a grooved portion of the holder 1A formed inside the peripheral wall 122 for case attachment and a bottom portion 3Ab radially formed with grooves so that it can be readily opened by the pressure of combustion gas. The open portion of the case 3A is formed with a peripheral edge portion 3Aa by fold-machining, and the peripheral wall 122 for case attachment of the holder 1A crimps the peripheral edge portion 3Aa to fix the case 3A in a state covering the upper side of the holder 1A. Moreover, the inside of the case 3A is charged internally with a prescribed amount of ignitor composition 31 and gas generating agent 32.

And in the gas generator B, when the impact at the time of a crash is applied to the electrode pins 21A as an electric signal, the resistor 26 between the pair of electrode pins 21A produces heat, and this heat ignites the primary charge 27, whereupon the ignitor composition 31 and the gas generating agent 32 are immediately inflamed. And then the combustion gas of the gas generating agent 32 breaks through the bottom portion 3Ab of the case 3A and discharges to the exterior, whereby the rapid winding-retraction means of the seatbelt is instantaneously activated by the pressure of the combustion gas.

Here, as with other vehicle parts, the need for cost reduction has risen also with regard to gas generators, and efforts are continuing at development worksites toward replacing expensive metal components with ones made of plastic and other synthetic resins. A challenge faced in this is how to give the parts replaced with synthetic resin ones the strength to withstand the pressure of the combustion gas while still maintaining the arrangement for rapidly retracting the seatbelt by efficiently releasing the combustion gas pressure from the bottom portion 3Ab so as to instantaneously drive a cylinder piston or a rotor. For example, in the case where the ring 22A and the insulator 23 in the gas generator B of FIG. 5 are replaced with synthetic resin ones, there is a risk of a problem arising under high-temperature condition, such as during a vehicle fire or the like, of this synthetic resin softening and the gas generating agent 32 inside the case 3A burning and projecting the electrode pins 21A outside from the side of the connector insertion hole 11.

[Patent Document 2]

On the other hand, Japanese Unexamined Patent Publication No. 2001-21293 (Patent Document 2), for example, teaches an invention wherein, with regard to the aforesaid plug, everything other than the electrode pins is replaced with synthetic resin, while the electrode pins are bent midway to expand the area of the electrode pins so as to maintain strength capable of withstanding the pressure of the combustion gas. The formation of the electrode pin bent portions can be expected to have an effect whereby the obstruction corresponding to the plug and its electrode pins do not disengage from the insertion hole provided on the vehicle body side.

[Patent Document 3]

Further, Japanese Unexamined Patent Publication No. 2004-114826 (Patent Document 3), for example, teaches a gas generator wherein the connector insertion hole provided in the holder is shaped like a pin-hole and used solely as a location for inserting the electrode pins, and the pair of electrode pins are twisted and provided integrally inside the holder 6. With this configuration, the twisted electrode pins are structured to catch in the direction of electrode pin extraction on a hole provided in a reinforcing member, so that the likelihood of the electrode pins flying outside the gas generator can be reduced.

PRIOR ART DOCUMENTS

Patent Documents

Patent Document 1: Japanese Unexamined Patent Publication No. 2003-205823

Patent Document 2: Japanese Unexamined Patent Publication No. 2001-21293

Patent Document 3: Japanese Unexamined Patent Publication No. 2004-114826

SUMMARY OF THE INVENTION

Problems to be Solved by the Invention

However, the primer device or squib set forth in Patent Document 2 unavoidably requires electrode pin yield to be lowered in order to obtain the desired bending. Further, if it is one in which the electrode pins are merely bent, it involves such problems as that under application of the combustion gas pressure they are apt to fly into the vehicle body from the connector insertion hole side while being twisted. Further, the gas generator set forth in Patent Document 3, particularly the ones equipped with the electrode pins disclosed in FIGS. 4 and 8, have bent portions in the electrode pins, similarly to in the primer device or squib of Patent Document 2, but the risk of their flying outside from the connecter insertion hole side is not adequately overcome. Moreover, an issue is present in that the number of production processes increases because a need arises to shape the electrode pins into a complex configuration in order to bend the electrode pins to the prescribed angle, again resulting in lower yield. When a problem of poor yield and a problem of an increased number of production processes are present in this way, the result is that the need for cost reduction cannot be satisfied.

Thus, in the conventional gas generator, replacement of expensive metal parts with plastic or other synthetic resin ones gives rise to structural issues such as ensuring required strength, with the result that inability to respond adequately to cost reduction demands became a problem.

Further, since the gas generator uses an electric primer, one challenge in the process of replacing conventional metal parts with insulative synthetic resin has been the constant need to configure the gas generator so as not to experience malfunction upon exposure to static electricity or the like.

The present invention, which is proposed in light of the foregoing circumstances, has as it object to provide a gas generator wherein the constituent members of the plug other than the electrode pins are replaced with synthetic resin and which ensures strength of the plug assembly so that the electrode pins do not fly out from the connector insertion hole side, while enabling fabrication at good yield, thus making it possible to thoroughly meet the need for cost reduction, and also making it possible to prevent malfunction caused by static electricity or the like.

Means for Solving the Problems (1) In order to achieve the aforesaid object, in a first invention of the present application, a gas generator comprising, a primer member including a mount portion for mounting a primary charge and at least two electrode pins projecting from a bottom surface of the mount portion and igniting the primary charge based on an electric signal passed through the electrode pins, a case charged with a gas generating agent for generating combustion gas upon ignition by the primer member, a holder having a pedestal including a single opening portion through which the plural electrode pins are inserted, the pedestal supporting the primer member, and on which the bottom surface of the mount portion is placed with the electrode pins inserted through the opening portion, having a mounting section for fitting a peripheral edge portion of the case, and having the case fitted thereover, wherein the primer member is configured so that the mount portion is formed of synthetic resin, the electrode pins are equipped midway with flange portions, and the flange portions are integrally formed in a state embedded inside the mount portion.

(2) In a second invention of the present application, in the gas generator of the aforesaid configuration the opening portion of the holder is formed in rectangular shape, and the flange portions of the electrode pins are given a larger diameter than short sides of the opening portion.

(3) In a third invention of the present application, it is required, for example, that, at locations of the same height in the horizontal direction, the flange portions of the individual electrode pins of the gas generator of the aforesaid configuration have an outer periphery of each flange portion out of contact with the outer periphery of the other electrode pin or the outer edge of the other flange portion.

(4) In the third invention of the present application in a gas generator, in addition to the aforesaid configuration, a minimum distance between the electrode pins and a periphery of the opening portion of the holder through which the electrode pins are inserted is 0.6 mm or less.

Effect of the Invention

The gas generator of the present invention is configured so that the mount portion of the primer member is formed of synthetic resin, the flange portions are provided midway of the electrode pins, and these flange portions are integrally formed in a state embedded inside the mount portion. Owing to this configuration, expensive metal parts and glass, ceramic or other such insulators can be replaced with ones made of synthetic resin. Further, since the whole of the primer member is prevented from flying out from the connector insertion hole side upon softening of the mount portion exposed to high temperature, electrode pins expanded in surface area are fabricated using the high-yield method of providing the flange portions midway of the pins. Therefore, the present invention can thoroughly meet the need for cost reduction.

In addition, with regard to such a gas generator, the opening portion of the holder is formed in rectangular shape and the flange portions are given a larger diameter than the short sides of this opening portion, so that the electrode pins can be easily inserted through with no contact or interference with the holder, without any particular increase in the number of processes. Further, in the case where the gas generator is heated to a high temperature by exposure to a high temperature from the outside, the electrode pins can be prevented from disengaging from the connector insertion hole side even if the pressure of the combustion gas acts on the electrode pins in the softened state of the synthetic resin, because the flange portions of the electrode pins catch on the opening portion of the holder. In particular, if the sum of the sector angles formed by the outer peripheral portions of the flange portions of the electrode pins located outside the rectangular opening portion of the holder in the axial direction and the electrode pins is configured to be 180 degrees or greater, the flange portions catch adequately on the holder. By this configuration, the tendency of the electrode pins to fly out from the connector insertion hole side owing to the pressure of the combustion gas can be effectively avoided, and a high level of electrode pin fabrication yield can be maintained. In other words, it becomes possible to provide a gas generator that adequately satisfies the need for cost reduction while further preventing the electrode pins from flying out from the connector insertion hole side.

Further, the flange portions of the individual electrode pins are configured so that the outer periphery of each flange portion is out of contact with the outer periphery of the other electrode pin or the outer edge of the other flange portion, so that the integral formation of the primer member can be performed with better yield. And, for example, the primer member can be fabricated with still better yield by using identically shaped ones for the respective electrode pins.

Moreover, the minimum distance between the electrode pins and the periphery of the opening portion of the holder through which these electrode pins are inserted is preferably made 0.6 mm or less. This configuration enables suitable discharge to the holder when static electricity is applied, making it possible to prevent malfunctions caused by static electricity and also contribute to quality improvement.

EXPLANATION OF REFERENCE SYMBOLS

Figure 1:
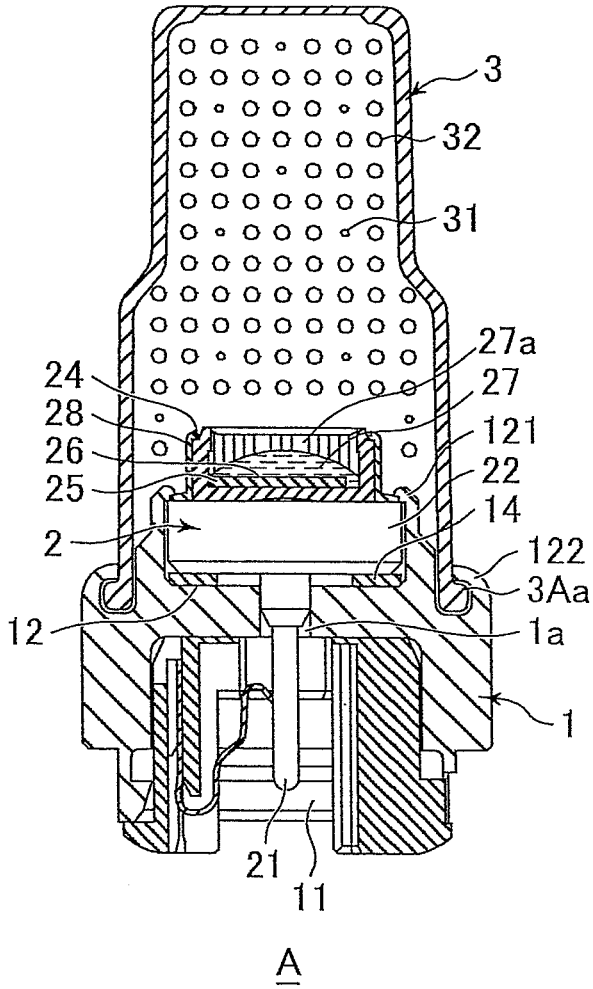
FIG. 1 is a schematic diagram partially in longitudinal section of an embodiment of a gas generator according to the present invention.

1*a* . . . Opening portion
A . . . Gas generator (Present invention)
B . . . Gas generator (Conventional)
1 . . . Holder
1A . . . Holder (Conventional)
11 . . . Connector insertion hole
12 . . . Pedestal
121 . . . Peripheral wall for ignitor unit attachment
122 . . . Peripheral wall for case attachment
13 . . . Spacer
14 . . . Gasket
2 . . . Plug assembly (Invention: Primer member)
2A . . . Plug assembly (Conventional)
21 . . . Electrode pin (Invention)
21*a* . . . Flange portion
21*r* . . . Outer peripheral portion of flange portion
21A . . . Electrode pin (Conventional)
22 . . . Ring (Invention: Mount portion)
22A . . . Ring (Conventional)
23 . . . Insulator
24 . . . Sleeve
25 . . . Board
26 . . . Resistor (Heating element)
27 . . . Primary charge
27*a* . . . Coating
3 . . . Case
3A . . . Case (Conventional)
3Aa . . . Peripheral edge portion
3Ab . . . Bottom portion
31 . . . Ignitor composition
32 . . . Gas generating agent
D . . . Minimum distance
R . . . Sector angle
O . . . Axis

MODE FOR CARRYING OUT THE INVENTION

Figure 5:
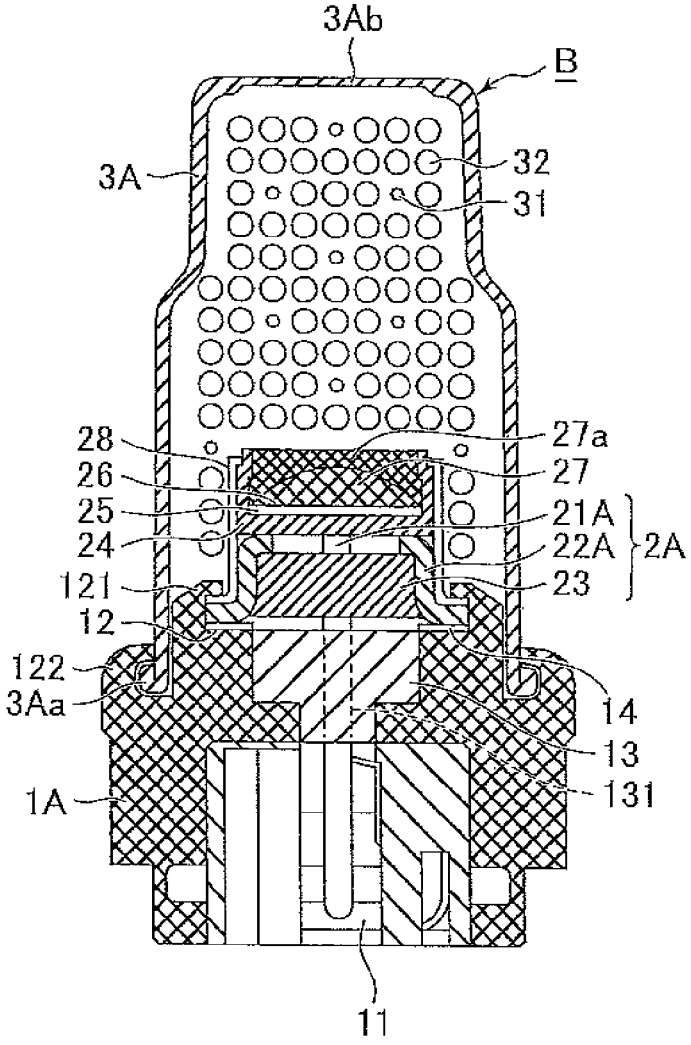
FIG. 5 is a schematic longitudinal sectional diagram of a conventional gas generator.

An embodiment of the present invention is explained below based on the drawings. Note that portions the same as or corresponding to the conventional gas generator shown in FIG. 5 are assigned like symbols and explanation thereof is omitted.

As shown in FIG. 1, the gas generator A according to the present invention comprises a ring 22 serving as a mount portion on which a primary charge 27 is mounted, and a plug assembly 2 serving as a primer member including a pair of electrode pins 21 projecting from the bottom surface of this ring 22, a case 3 charged with an ignitor composition 31 and gas generating agent 32 for generating combustion gas upon ignition by the primary charge 27 based on an electric signal passed through the electrode pins 21, and a holder 1 fitted in the lower peripheral edge of said case 3.

The ring 22 serving as the mount portion is made of synthetic resin, more specifically of an insulating resin, and can be constituted, for example, as a composite material obtained by incorporating carbon fiber, a silica such as fused silica or crystalline silica, alumina, silicon nitride, aluminum nitride, boron nitride, titanium oxide, glass fiber or other reinforcing agent, antistatic agent and like additives into a resin such as polybutylene terephthalate (PBT) or polyphenylene sulfide (PPS). When the softening point of the synthetic resin is low, the flame retardancy and high-temperature strength of the ring 22 can be suitably adjusted by regulating the composition ratios of the additives incorporated in the synthetic resin.

Note that the primary charge 27 is mounted on the ring 22 via a cup-shaped sleeve 24 and a board 25. In other words, as noted earlier, the primary charge 27 is mounted on the board 25 placed inside the sleeve 24 on the bottom surface thereof, and a resistor 26 is provided as a heating element on at least one surface of the board 25. The primary charge 27 is placed on this resistor 26 and a coating 27*a* is additionally placed thereover. Further, the holder 1 is formed with an opening portion 1*a* for inserting the electrode pins 21, a pedestal 12 for supporting the plug assembly 2 on the bottom surface of the ring 22, and the peripheral wall 122 for case attachment serving as a mounting section for fitting the peripheral edge portion 3Aa at the lower end of the case.

Figure 2:
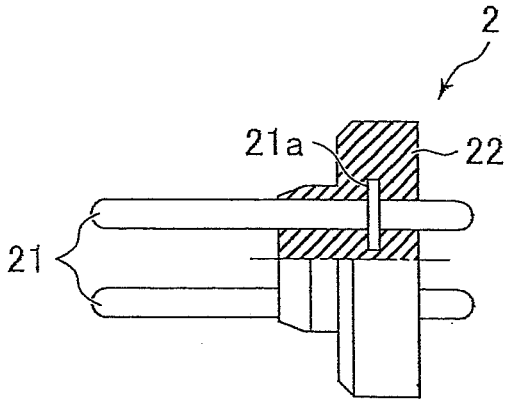
FIG. 2 is an enlarged view partially in section of a plug assembly (primer member) in FIG. 1.

Particularly, as shown in FIG. 2, the plug assembly 2 is preferably configured such that the ring 22 is formed of the aforesaid insulating resin or composite material, the electrode pins 21 are equipped midway thereof with flange portions 21*a*, and these flange portions 21*a* are integrally formed in a state embedded inside the ring 22.

In the following, the individual components of the gas generator A according to the present invention are explained while comparing the embodiment of the present invention shown in FIGS. 1 to 4 with the conventional example shown in FIG. 5, with the focus on parts configured differently from the aforesaid conventional example.

First, the holder 1 of the gas generator A according to the present invention is formed of aluminum or zinc as heretofore, but unlike in the conventional gas generator B of FIG. 5, no spacer 13 is provided, as is seen in FIG. 1. In other words, the configuration is directly provided at the center region of the pedestal 12 with the rectangular opening portion 1*a* as a rectangular through-hole for communicating with a connector insertion hole 11. Therefore, in the present invention, a gasket 14 is installed near the outer edge of the pedestal 12 as a sealing material, and the plug assembly 2 provided with the pair of electrode pins is mounted on the pedestal 12 to sandwich the gasket 14.

Further, in the present invention, differently from the ring 22A and insulator 23 of the conventional gas generator B, the ring 22 of the plug assembly 2 is made of a resin such the polybutylene terephthalate or polyphenylene sulfide set out above or of a highly insulative composite material. Therefore, as shown in FIG. 2, in the plug assembly 2 of the present invention, the flange portions 21*a* provided midway of the electrode pins 21 can be configured by forming them integrally in a state embedded inside the ring 22. In addition, the point that the pair of electrode pins 21 passing through this ring 22 are provided midway with the disk-shaped flange portions 21*a* also differs from the conventional gas generator B.

Figure 3:
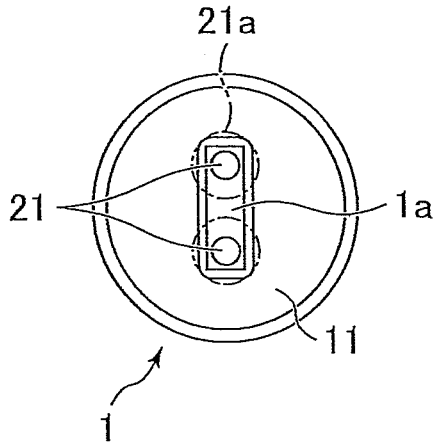
FIG. 3 is a schematic explanatory diagram of an essential portion viewing a gas generator according to the present invention from the bottom, and showing flange portions used in the embodiment of FIG. 1 in imaginary lines in order to explain the relationship between an opening portion of a holder and electrode pin flange portions.
Figure 4:
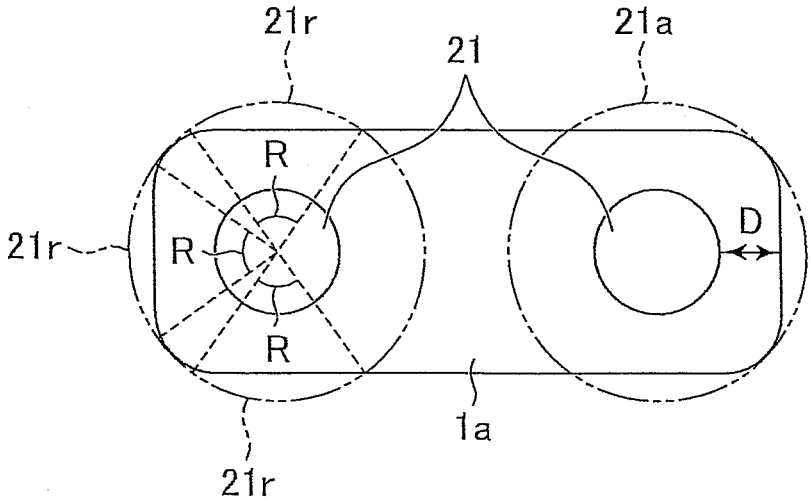
FIG. 4 is a schematic explanatory diagram of an essential portion for explaining the relationship between the opening portion of the holder and the electrode pin flange portions in FIG. 3 in further detail.

In addition, as shown in FIG. 3, the diameter of these flange portions 21*a* are larger than the short sides of the opening portion 1*a* of the holder 1, and further, as shown in FIG. 4, the sum of the sector angles R formed by the outer peripheral portions 21*r* of the flange portions located outside the opening portion 1*a* of the holder 1 in the axial direction and the axes O of the electrode pins is established to be 180 degrees or greater, for example, 180 degrees. Further, as shown in FIG. 2, the flange portions 21*a* have a size of such degree that the outer periphery of each does not contact the outer periphery of the other and are required to have a size and thickness of a degree whereby they are not easily deformed by the heat, pressure and impact of combustion gas generated in the case 3. Note that as the pair of electrode pins 21 can be used electrode pins that are identical to each other. The thickness and length of the electrode pins 21 are decided with the ability to detachably insert them in the connecter as the main condition.

Further, the electrode pins 21 and flange portions 21*a* are made of the same metal material, and from the viewpoint of strength, an iron alloy such as iron-nickel alloy is preferably used.

Note that the case 3 used in the present invention can be one configured the same as in the conventional gas generator B.

Here, as shown in FIG. 4, in the gas generator A according to the present invention, the minimum distance D between the electrode pins 21 and the periphery of the opening portion 1*a* of the holder 1 through which the these electrode pins 21 are inserted is made 0.6 mm or less, for example, 0.5 mm. In other words, the electrode pins 21 are first inserted through the rectangular opening portion 1*a* of the holder 1 so that the minimum distance D from the periphery of the opening portion 1*a* of the holder 1 to electrode pins 21 becomes 0.5 mm, and the plug assembly 2 is incorporated to be held on the bottom surface of the ring 22. Then, as with the conventional gas generator B, the plug assembly 2 is bent by swaging the peripheral wall 121 for primer unit attachment to fix the plug assembly 2 to the holder 1. Note that the gasket 14 establishes air-tightness between the holder 1 and the plug 2 by the swaging and crushing of the peripheral wall.

Thus, in the gas generator A according to the present invention, the metal ring 22A and the glass, ceramic or other such insulator 23 of the conventional gas generator B are integrally constituted of synthetic resin or highly insulative composite material, whereby cost reduction can be achieved. In addition, since the flange portions 21*a* are provided midway of the electrode pins 21 and these flange portions 21*a* are constituted to be integrally formed in a state embedded inside the ring 22, the problem caused by constituting the ring 22 of synthetic resin can be overcome. Specifically, when the ring 22 softens, it is possible to overcome the problem of the electrode pins 21 flying outside from the connector insertion hole 11 side owing to the pressure of the combustion gas. Further, the flange portions 21*a* are disk-shaped and the structure therefore makes application of twisting force to the electrode pins 21 less likely than in the aforesaid Patent Documents 2 and 3, so that the electrode pins 21 are resistant to flying out from the connector insertion hole 11 side. In addition, advantage can be taken of ring 22 cost reduction because the flange portions 21*a* are easy to fabricate owing to their disk-like shape, thus making it possible to fabricate the electrode pins 21 with good yield. Further, the flange portions 21*a* are given a larger diameter than the short sides of the rectangular opening portion 1*a* of the holder 1, and in addition, the sum of the sector angles R formed by the outer peripheral portions 21*r* located outside the opening portion 1*a* of the holder 1 in the axial direction and the electrode pins 21 is made 180 degrees. Owing to this configuration, the electrode pins 21 can be more reliably prevented from flying out from the connector insertion hole 11 side owing to the pressure of the combustion gas, while taking advantage of the good yield in the fabrication of the electrode pins 21. Further, the pair of electrode pins 21 are both given the same shape, thereby enabling the plug assembly 2 to be fabricated with good yield, while establishing a prescribed interval between the flange portions 21*a* of the pair of electrode pins 21 so that the outer periphery of each does not contact the outer periphery of the other.

In addition, in the gas generator A according to the present invention, the minimum distance D between the electrode pins 21 and the periphery of the opening portion 1*a* of the holder 1 through which the electrode pins 21 are inserted is not particularly limited insofar as insulation from the holder 1 is ensured. However, from the viewpoint of establishing both insulation property of up to around 500 V and dischargeability to the holder 1 of static electricity of around 25,000 V, it is preferably made 0.1 mm to 0.6 mm or less, for example, 0.5 mm. By establishing the aforesaid minimum distance D in the aforesaid range, passage to the holder of the current of the electric signal applied to the electrode pins 21 can be avoided, and when static electricity is applied, it can be suitably discharged to the holder 1 to prevent malfunction owing to static electricity.

Further, according to the present invention, the spacer 13 and insulator 23 required by the conventional gas generator B become unnecessary to enable a cutback in the number of parts and thereby make it possible to realize cost reduction.

Therefore, in the present invention, the ring 22 can be replaced with one made of synthetic resin and the electrode pins 21 and plug assembly 2 can be fabricated with good yield, thereby making it possible to thoroughly meet the need for cost reduction, and, in addition, a gas generator A can be provided that is capable of preventing malfunction owing to static electricity.

Although an embodiment of the present invention is set forth in the foregoing, the present invention is not limited to the aforesaid embodiment. And it is possible in the present invention to make various design changes in the shape and the like of the gas generator of the present invention insofar as they do not depart from the matters set out in the scope of claims.

Further, it goes without saying that as the materials and the like used in the individual constituents of the gas generator of the present invention can be used publicly-known or well-known raw materials insofar as they do not depart from the matters set out in the scope of claims.

Therefore, in the gas generator of the present invention, preferred embodiments are obtained in all modes provided that the flange portions of the electrode pins are larger in diameter than the short sides of the opening portion of the holder and the sum of the sector angles formed by the outer peripheral portions located outside the opening portion of the holder in the axial direction and the electrode pins is made 180 degrees or greater. For example, the outer shape of the flange portions of the electrode pins can be configured in polygonal shapes like triangular, rectangular or trapezoidal, or in elliptical and other desired non-circular shapes. Further, even if the outer shapes of the flange portions of the electrode pins differ from each other, it is possible to reliably prevent the electrode pins from flying out from the connector insertion hole side owing to the pressure of the combustion gas insofar as the aforesaid conditions regarding the sector angles is satisfied.

Further, if the minimum distance between the electrode pins and the periphery of the opening portion of the holder through which these electrode pins are inserted is made 0.6 mm or less, any static electricity that should be applied can be suitably discharged to the holder to make it possible to prevent malfunction owing to static electricity, which is still more preferable. Note that in the present invention, electrode pins can be used whose sectional shape is other than circular, such as elliptical or polygonal.

The scope of the right in the present invention also extends to a configuration wherein the height location of the flange portions is differed in level in order to make the flange portions of the electrode pins mutually non-contacting and large in diameter. However, a pair of electrode pins constituted to be non-contacting at the same height level in the horizontal direction come to be electrode pins of the same shape, which is a preferable embodiment because it enables the primer member to be fabricated with still better yield.

Note that since synthetic resin is charged between each electrode pin or its flange portion and the other electrode pin or the other flange portion, the minimum distance therebetween is not particularly limited insofar as they do not contact each other, and insulation property can be adequately established at a clearance of around 0.5 mm. Therefore, the distance between the electrode pins is decided with the pitch of the insertion holes of the connector used as the main condition.

Further, in the aforesaid embodiment, the number of electrode pins is defined as two so as to improve the yield of the electrode pins. However, the plug assembly can be constituted using three or more electrode pins provided that they are properly inserted in the connector insertion hole and the minimum distance from the opening portion of the holder satisfies the aforesaid relationship.

INDUSTRIAL APPLICABILITY

As explained above, the gas generator having the configuration of the present invention makes it possible to replace expensive metal parts and glass, ceramic or other such insulators with ones made of synthetic resin and enables production by a very high yield production method, thus making it possible to thoroughly satisfy the need for cost reduction.

Further, when the pressure of combustion gas acts on the electrode pins with the synthetic resin parts in a state softened by exposure to high temperature from the outside, disengagement of the electrode pins from the connector insertion hole side can be effectively prevented in the case of the gas generator of the present invention.

Being additionally configured to prevent malfunction owing to static electricity, the gas generator of the present invention has high reliability compared to conventional gas generators.

The invention claimed is:

1. A gas generator comprising, a primer member including a mount portion for mounting a primary charge and at least two electrode pins projecting from a bottom surface of the mount portion and igniting the primary charge based on an electric signal passed through the electrode pins, a case charged with a gas generating agent for generating combustion gas upon ignition by the primer member, a holder having a pedestal including a single opening portion through which all the electrode pins are inserted, the pedestal supporting the primer member, and on which the bottom surface of the mount portion is placed with the electrode pins inserted through the opening portion, having a mounting section for fitting a peripheral edge portion of the case, and the mounting section fitting over the case, wherein the primer member is configured so that the mount portion is formed of synthetic resin, the electrode pins are equipped midway with flange portions, and the flange portions are integrally formed in a state embedded inside the mount portion, and the flange portions of the electrode pins are larger in diameter than short sides of the opening portion of the holder and the sum of the sector angles formed by the outer peripheral portions located outside the opening portion of the holder in the axial direction and the electrode pins is made 180 degrees or greater.

2. A gas generator as claimed in claim 1, wherein the opening portion of the holder is formed in rectangular shape.

3. A gas generator as claimed in claim 2, wherein the flange portions of the individual electrode pins have an outer periphery of each flange portion out of contact with the outer periphery of the other electrode pin.

4. A gas generator as claimed in claim 3, wherein a minimum distance between the electrode pins and a periphery of the opening portion of the holder through which the electrode pins are inserted is 0.1 mm to 0.6 mm or less.

5. A gas generator as claimed in claim 2, wherein a minimum distance between the electrode pins and a periphery of the opening portion of the holder through which the electrode pins are inserted is 0.1 mm to 0.6 mm or less.

6. A gas generator as claimed in claim 1, wherein the flange portions of the individual electrode pins have an outer periphery of each flange portion out of contact with the outer periphery of the other electrode pin.

7. A gas generator as claimed in claim 6, wherein a minimum distance between the electrode pins and a periphery of the opening portion of the holder through which the electrode pins are inserted is 0.1 mm to 0.6 mm or less.

8. A gas generator as claimed in claim 1, wherein a minimum distance between the electrode pins and a periphery of the opening portion of the holder through which the electrode pins are inserted is 0.1 mm to 0.6 mm or less.

* * * * *